US005163307A

United States Patent [19]

Jahn et al.

[11] Patent Number: 5,163,307

[45] Date of Patent: Nov. 17, 1992

[54] APPARATUS FOR CONTROLLING THE WARP BEAM OF A WARP KNITTING MACHINE

[75] Inventors: Wolfgang Jahn, Naila; Alfed Schnabel, Issigau, both of Fed. Rep. of Germany

[73] Assignee: LIBA Maschinenfabrik GmbH, Fed. Rep. of Germany

[21] Appl. No.: 701,680

[22] Filed: May 16, 1991

[30] Foreign Application Priority Data

May 16, 1990 [DE] Fed. Rep. of Germany ..... 4015763

[51] Int. Cl.[5] ..... D04B 27/22

[52] U.S. Cl. ..... 66/212; 33/778; 139/105

[58] Field of Search ..... 66/209, 210, 211, 212; 139/105, 106, 107, 108; 242/67.5; 33/778

[56] References Cited

U.S. PATENT DOCUMENTS

| | | | |
|---|---|---|---|
| 3,727,033 | 4/1973 | Bassist | 66/209 X |
| 3,780,541 | 12/1973 | Haynes | 66/210 X |
| 3,824,694 | 7/1974 | Lespenance et al. | 33/778 |
| 3,858,415 | 1/1975 | Wilson et al. | 66/210 |
| 3,930,523 | 1/1976 | Garcia | 139/108 |
| 4,430,870 | 2/1984 | Winter et al. | 66/210 |
| 4,529,012 | 7/1985 | Sanen et al. | 139/108 X |
| 4,662,407 | 5/1987 | Duncan | 66/210 X |

FOREIGN PATENT DOCUMENTS

| | | | |
|---|---|---|---|
| 768521 | 11/1971 | Belgium | 139/108 |
| 926111 | 5/1982 | U.S.S.R. | 66/212 |
| 1068563 | 1/1984 | U.S.S.R. | 66/209 |
| 1308660 | 5/1987 | U.S.S.R. | 66/209 |
| 1414474 | 11/1975 | United Kingdom | 66/212 |

*Primary Examiner*—Werner H. Schroeder
*Assistant Examiner*—Larry D. Worrell, Jr.
*Attorney, Agent, or Firm*—Bell, Seltzer, Park & Gibson

[57] ABSTRACT

An apparatus for controlling the drive mechanism of the warp beam of a warp knitting machine is disclosed. A pressure roll is carried by a support arm biased toward the warp beam so that the pressure roll engages the warp beam. The pressure roll is operatively connected to a signal generator which emits signals representative of the speed and thus, the amount of yarn withdrawn from the warp beam. A controller receives the generated signals compares the signals to a predetermined knitting machine operating standard. A control signal is generated to the warp beam drive mechanism for controlling the speed of yarn delivery from the warp beam. The control signal is amplified in an amount proportional to the decrease in diameter of the warp beam whereby the control signal is amplified more as the diameter of the warp beam decreases so that the warp beam drive mechanism receives stronger control signals and achieves greater response in warp beam speed control when increased acceleration and deceleration of the warp beam occurs at smaller warp beam diameters.

4 Claims, 1 Drawing Sheet

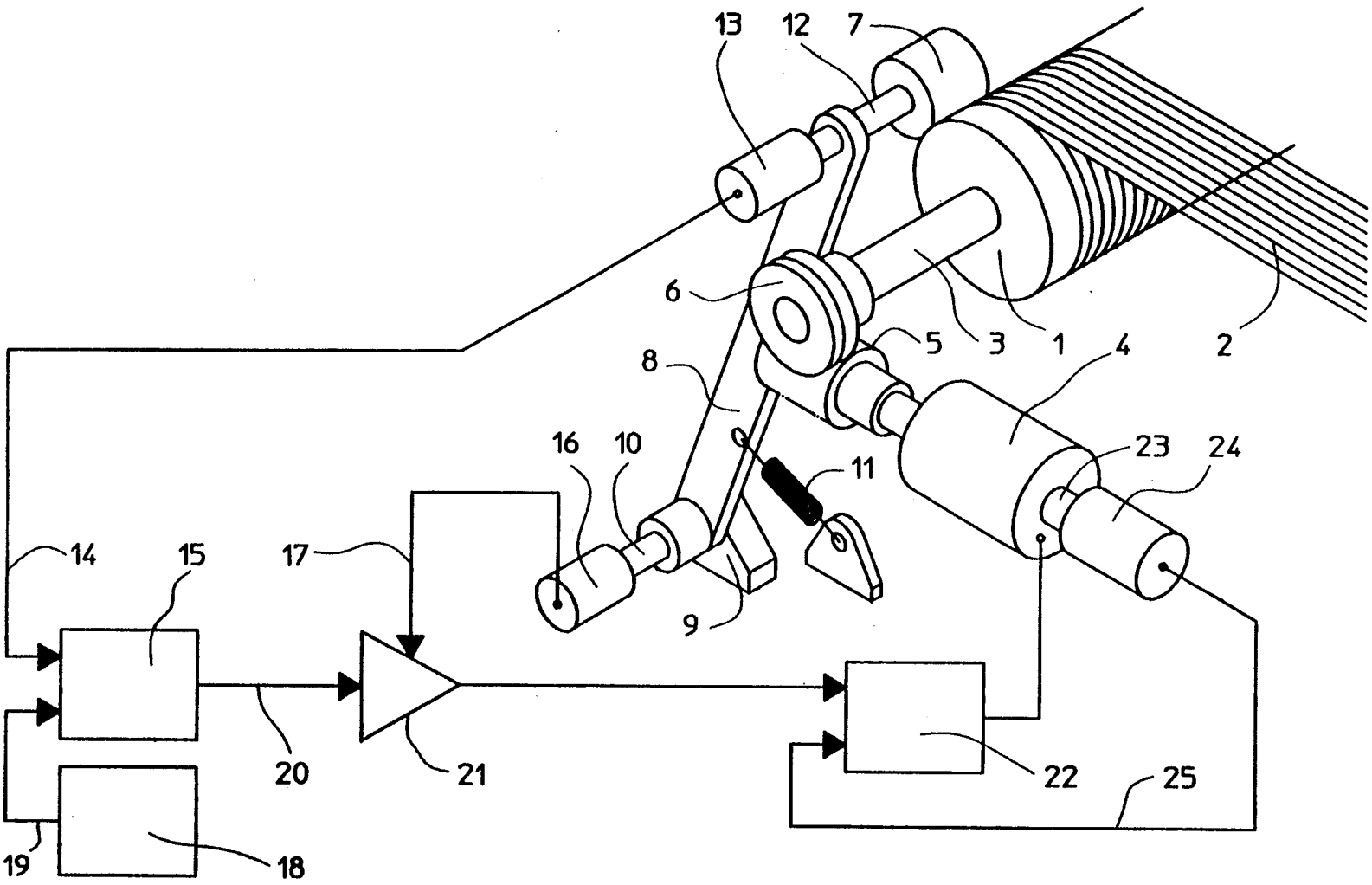
2
24
23
4
1
3
5
7
12
13
6
8
11
9
10
16
25
22
21
17
20
15
18
14
19

APPARATUS FOR CONTROLLING THE WARP BEAM OF A WARP KNITTING MACHINE

FIELD OF THE INVENTION

The present invention relates to an apparatus for controlling the warp beam of a warp knitting machine in which generated signals for controlling the warp beam drive mechanism are amplified in an amount proportional to the decrease in diameter of the warp beam.

BACKGROUND OF THE INVENTION

In one known apparatus for controlling the warp beam of a warp knitting machine, German Patent DEOS 3832695 discloses a pressure roll engages the warp beam and drives a tachogenerator which produces electrical signals representing the actual yarn delivery speed, and thus a value of the amount of yarn delivered. In this apparatus, a controller, such as a conventional microprocessor, compares the generated signals with a predetermined knitting machine operating standard derived from the yarn consumption per knitting loop, a stored pattern program, and the desired yarn consumption for each knitting course.

A control signal is generated to the drive mechanism of the warp knitting machine for controlling the speed of the warp drive mechanism. In one embodiment of this known apparatus, the drive mechanism is interposed in a control loop which allows a comparison of the control signal with the actual speed of the drive mechanism as measured by a second signal generator operatively connected to the warp beam drive motor. A signal generator operatively connected to the support arm generates a pivot signal representative of the angulation of the support arm toward the warp beam to determine the diameter of the yarns wound on the warp beam. Based upon this measured diameter, the warp beam drive mechanism is set accordingly.

Operational problems arise in this warp knitting machine control system because the control system tends to oscillate as a result of the decreasing diameter of the warp beam. Because the moment of inertia of a warp beam changes considerably as its diameter decreases, i.e., with the fourth power of the radius of the warp beam, the control signal and in the control loop tend to oscillate, especially when the warp beam diameter is small. A small diameter warp beam must be accelerated or decelerated quickly to compensate for the quickly varying yarn feed requirements which vary from course to course.

When the generated signals are electronically damped, the warp beam drive mechanism responds to the control signals much more slowly. This problem becomes more apparent when the drive of the warp beam is controlled individually with respect to the yarn withdrawal speed for each course of stitch loops within a repeat to satisfy the yarn delivery requirements, which differ from one course to another.

In accordance with the present invention, it has been discovered necessary to amplify the control signal when the warp beam diameter is small to gain increasing control over the warp beam. The amplification should not occur, however, when the warp beam has a relatively large diameter produced by the full yarns wound on the warp beam. A greatly amplified control signal would lead to a relatively intensive control and overshooting of the desired change in the warp beam yarn withdrawal rate so that the large diameter warp beam would accelerate or decelerate faster than desired. In view of the greater inertia of the larger diameter warp beam, the result is a corresponding longer decay time. For this reason, the amplification for larger diameter warp beams must be reduced to prevent the overreaction in the warp beam control.

SUMMARY OF THE INVENTION

It is therefore an object of the present invention to provide an apparatus for controlling the warp beam of a warp knitting machine in which a generated signal for controlling the speed of the warp beam drive mechanism is amplified more as the diameter of the warp beam decreases.

It is another object of the present invention to provide an apparatus for controlling the warp beam of a warp beam knitting machine in which a pressure roll engages the warp beam and generates through a signal generator a signal representative of the amount of yarn delivered from the warp beam and in which the signals are received in a controller and compared with a predetermined knitting machine operating standard from which an amplified warp beam control signal proportional to the decrease in the warp beam diameter is generated.

In accordance with the present invention, the apparatus for controlling the warp beam drive mechanism of a warp knitting machine includes a mounting support member positioned adjacent the warp beam. A support arm is pivotally mounted on the mounting support member. A pressure roller is rotatably mounted on the support arm. The support arm is biased toward the warp beam so that the pressure roll engages the warp beam and rotates therewith as yarn is withdrawn.

A signal generator is operatively connected to the pressure roll for generating signals representative of the speed, and hence, the amount of yarn withdrawn from the warp beam. Control means operatively connected to said signal generator and the drive mechanism of the warp beam 1) receives the generated signals, 2) compares the generated signals to a predetermined standard and 3) generates a control signal to the drive mechanism representative of the desired speed of the warp beam. A second signal generator is operatively connected to the support arm for generating a pivot control signal representative of the angular position of the support arm toward the warp beam.

An amplifier receives the control signal and the pivot control signal and amplifies the control signal in response to the pivot signal in an amount proportional to the decrease in diameter of the warp beam. Thus, the control signal is amplified more as the diameter of the warp beam decreases so that the warp beam drive mechanism receives stronger control signals and achieves greater response in warp beam speed control when increased acceleration and deceleration of the warp beam occurs at smaller warp beam diameters.

The warp beam drive mechanism includes a signal generator for generating signals representative of the speed of the warp beam. A controller compares the control signal with the warp beam drive mechanism signal. In the preferred embodiment the signal generators comprise pulse generators.

DETAILED DESCRIPTION OF THE PREFERRED EMBODIMENT

FIG. 1 shows a warp beam 1 of a knitting machine from which yarns 2 are withdrawn. The warp beam 1 is driven on its shaft 3 by a warp beam drive motor 4 connected to the warp beam by a worm 5 and worm wheel 6. Engaged with the surface of the warp beam 1 is a contact pressure roll 7 which is supported by a support arm 8. The support arm s is rotatably supported on a carrier 9 of a shaft 10 mounted on the machine frame. A spring 11 biases the support arm 8 constantly in a direction toward the warp beam 1 so that the pressure roll 7 always engages the warp beam 1.

Mounted on a shaft 12 of the contact pressure roll 7 is a signal generator 13 which supplies signals corresponding to the instantaneous yarn withdrawal speed and thus the amount of yarn withdrawn. The signals are transmitted through a communication line 14 to a controller 15 in the form of a comparator. A large number of different conventional microprocessors can be used in the present invention. The generated signals may be a potential or a pulse train.

Attached to the shaft 10 of the pivot arm 8 is a pivot signal generator 16, constructed in conventional manner, such as for example, a potentiometer, which delivers through a communication data line 17 a pivot signal representing the angular position of the support arm and thus, the respective diameter of the warp beam 1. The comparator is contained in the illustrated circuit arrangement and also receives a predetermined knitting machine operating standard which is determined by a computer 18 and supplied to the comparator 15 through a data communication line 19. This predetermined knitting machine operating standard is calculated from a corresponding input, which could include for example, the desired yarn consumption per course of stitch loops, the laying of the yarn and the yarn material. The comparator 15 generates in known manner a control signal through a data communication line 20 to an amplifier 21. The amplifier 21 output is adjustable with respect to its degree of amplification. The pivot signal generator 16 connects to the amplifier 21. The amplifier output adjustment is effected by the pivot control signal supplied through the data communication line 17.

The amplified control signal delivered by the amplifier 21 is supplied in a norma) manner and through a further comparator 22 to the drive motor 4 of the warp beam 1. The motor shaft 23 includes a signal generator 24 which generates actual warp beam operating signals through a data communication line 25 to the comparator 22. The comparator 22 is integrated in a control loop and the signal generator 24 compares the amplified control signal with the actual warp beam signal generated by the signal generator 24 and emits a signal to adjust in normal manner the speed of the warp beam drive motor 4 to the control signal value.

At a relatively large diameter of the warp beam 1, such as when knitting initially begins, the signal generator 16 delivers a pivot control signal as a result of a corresponding change in angulation of the pivot arm 8. That pivot control signal steps down the amplification of the amplifier, so that the control signal supplied through the date communication line 20 is amplified weakly by the amplifier 21. When the warp beam 1 diameter has decreased, the signal generator 16 delivers a pivot signal which increases the amplification of the amplifier 21 so that the warp beam drive motor 4 receives increased control signals leading to a correspondingly stronger response of the warp beam drive motor 4.

The adjustment of the degree of the control signal amplification proportional to the warp beam diameter aids in compensating for the oscillations which occur in the system. Additionally, at smaller warp beam diameters when the warp beam tends to accelerate and decelerate more, greater amplification of the warp beam control signal allows greater control over the warp beam control. Because the signal amplification decreases as the warp beam diameter increases, overshooting of the control signal is minimized.

While a specific embodiment of the invention has been specifically shown and described, it will be understood that this was for purposes of illustration only, and not for purposes of limitation, the scope of the invention being in accordance with the following claims.

That which is claimed is:

1. An apparatus for controlling the warp beam drive mechanism of a warp knitting machine comprising a mounting support member positioned adjacent the warp beam, a support arm pivotally mounted to the mounting support member, a pressure roll rotatably mounted on the support arm and engaging the warp beam and rotating therewith as yarn is withdrawn, means connected to the support arm for biasing the support arm toward the warp beam so that the pressure roll engages the warp beam as yarn is withdrawn, a signal generator operatively connected to the pressure roll and generating signals representative of the speed at which yarn is withdrawn from the warp beam, control means operatively connected to said signal generator and the drive mechanism of the warp beam for 1) receiving the generated signals, 2) comparing the generated signals to a predetermined knitting machine operating standard and 3) generating a control signal to the warp beam drive mechanism representative of the desired speed of the warp beam, signal generating means operatively connected to the support arm for generating a pivot signal representative of the angular position of the support arm toward the warp beam, and an amplifier which receives the control signal and the pivot signal and amplifies the control signal in response to the pivot signal in an amount proportional to the decrease in diameter of the warp beam whereby the control signal is amplified more as the diameter of the warp beam decreases so that the warp beam drive mechanism receives stronger control signals and achieves greater response in warp beam speed control at smaller warp beam diameters.

2. The apparatus according to claim 1 wherein said warp beam drive mechanism includes a signal generator for generating warp beam drive signals representative of the rotational speed of the warp beam and including means for comparing the control signal with the warp beam drive signal.

3. The apparatus according to claim 1 wherein said means biasing said support arm toward said warp beam comprises a spring.

4. The apparatus according to claim 1 wherein said signal generator comprises a pulse generator.

* * * * *

UNITED STATES PATENT AND TRADEMARK OFFICE

CERTIFICATE OF CORRECTION

PATENT NO. : 5,163,307

DATED : November 17, 1992

INVENTOR(S) : Wolfgang Jahn et al

It is certified that error appears in the above-indentified patent and that said Letters Patent is hereby corrected as shown below:

Column 3, before "DETAILED DESCRIPTION OF THE PREFERRED EMBODIMENT" insert the following: --"DESCRIPTION OF THE DRAWINGS FIG. 1 is a schematic perspective view of the invention and control circuit--.

Column 3, line 10, change "arm s" to --arm 8--.

Column 3, line 47, change "norma)" to --normal--.

Claim 1, column 4, line 22, change "the" to --a--.

Claim 1, column 4, line 34, change "representative of" to --representing--.

Claim 1, column 4, line 48, change "proportional" to --relative--.

Claim 2, column 4, lines 57-58, change "representative of" to --representing--.

Signed and Sealed this

Twelfth Day of October, 1993

Bruce Lehman

*Attest:*

BRUCE LEHMAN

*Attesting Officer*

*Commissioner of Patents and Trademarks*